US010550563B1

(12) United States Patent
Kozlowski

(10) Patent No.: US 10,550,563 B1
(45) Date of Patent: Feb. 4, 2020

(54) LINEAR WALL DRAIN WITH REMOVABLE ACCESS PANEL

(71) Applicant: Miroslaw Kozlowski, Trumbull, CT (US)

(72) Inventor: Miroslaw Kozlowski, Trumbull, CT (US)

(73) Assignee: Drains Unlimited LLC, Darien, CT (US)

( * ) Notice: Subject to any disclaimer, the term of this patent is extended or adjusted under 35 U.S.C. 154(b) by 0 days.

(21) Appl. No.: 16/185,549

(22) Filed: Nov. 9, 2018

(51) Int. Cl.
*E03F 5/04* (2006.01)
*E03C 1/22* (2006.01)

(52) U.S. Cl.
CPC ..... *E03F 5/0408* (2013.01); *E03C 1/22* (2013.01)

(58) Field of Classification Search
CPC ..... E03C 1/22; E03F 5/0408
See application file for complete search history.

(56) References Cited

U.S. PATENT DOCUMENTS 10,240,332 B1 * 3/2019 Stetson ..... E03F 5/06
2010/0162481 A1 * 7/2010 Erlebach ..... E03F 5/04 4/613
2011/0162137 A1 * 7/2011 Kik, Sr. ..... E03F 3/046 4/613
2011/0203979 A1 * 8/2011 Schlueter ..... E03F 5/04 210/164
2012/0110827 A1 * 5/2012 Doolittle ..... E03F 5/0408 29/527.1
2013/0000034 A1 * 1/2013 Wedi ..... E03F 5/0408 4/613
2013/0276226 A1 * 10/2013 Cook ..... A47K 3/40 4/613
2016/0130794 A1 * 5/2016 Erlebach ..... E03F 5/0408 4/613
2016/0174773 A1 * 6/2016 Summers ..... A47K 3/40 4/613
2017/0241124 A1 * 8/2017 Erlebach ..... A47K 3/40
2018/0038091 A1 * 2/2018 Ismert ..... E03F 5/0404
2018/0155915 A1 * 6/2018 Meyers ..... E03F 5/0408

OTHER PUBLICATIONS

Wall Drain with Recessed and Floor Curbless Entry by QUcik Drain USA—Undated Document - 1 page.

* cited by examiner

*Primary Examiner* — Paola Agudelo
(74) *Attorney, Agent, or Firm* — St. Onge Steward Johnston & Reens LLC

(57) ABSTRACT

A linear wall drain that includes a removable faceplate and is adapted to be secured to a recessed front wall, the faceplate including at least one magnet that is affixed to a front surface of the recessed front wall and at least one magnet affixed to a rear surface of the faceplate such that the two magnets will removeably hold the faceplate to the recessed front wall when the two magnets are aligned.

22 Claims, 5 Drawing Sheets

LINEAR WALL DRAIN WITH REMOVABLE ACCESS PANEL

FIELD OF THE INVENTION

The invention relates to the field of drains, and more particularly, to linear wall drains having a removable face plate such as are used in a shower or bathroom.

BACKGROUND OF THE INVENTION

Drains have been used in bathroom environments for many decades. They are typically connected, via a trap, to a water disposal system such as a city sewer system or to a septic tank or field positioned in the vicinity of the facility.

One type of drain that has become increasingly popular is a linear drain configuration. Linear drains, such as those used in a shower, have become popular for aesthetic reasons. This is due to the fact that a linear wall drain will "hide" the drain pipe while allowing water to escape from the shower via an elongated opening that would typically be located at the base of a wall. This elongated opening is not overtly apparent and when viewed from an angle (e.g., from eye level), it fades from view, especially when darker colored tile or marble is used to cover the surfaces of the shower. It is aesthetically pleasing to cover the linear wall drain with the same tile or marble that is used to cover the surfaces of shower such that the wall drain is substantially invisible on casual inspection.

A drawback of linear wall drains is the difficulty in keeping the drain clean and clear of debris. Most wall drains have pan into which the water from the shower will fall and then exit through an opening in the bottom of the pan. But the pan, as well as other parts of the linear drain can become dirty and need to be wiped down and sanitized as well has having debris removed that may become lodged therein. This is a difficult task where the opening to the linear wall drain is designed to be very low profile so that it is difficult to see on casual examination. This in turn means that the linear opening will be very narrow and just big enough to allow for the free flow of water from the shower into the pan. Such and opening does not allow for access for cleaning the pan in any meaningful way.

One approach has been to provide a face plate that can be removed to open a larger area so that the interior of the linear drain can be accessed. One configuration provided by Quick Drain USA allows for a tile cover to be detachably affixed to the face of the linear drain as shown. http://www.quickdrainusa.com/products/wall-drain/walld48/ A major drawback of this design, however, is that the device is difficult to install. For example, the magnets are shown positioned on an outer face of the "TileIn Cover", which are then covered by "Transition Tape." This is then supposed to be covered by "Thin Set" and then the "Tile" to be placed over that. This renders the magnets inaccessible underneath the tile. Additionally, the uneven surface that the magnets present make it difficult to set the tile in a smooth and even manner.

Another problem with that configuration is that when face plate is removed, it is important that the opening granting access to the interior of the drain present only smooth (e.g., rounded or beveled) edges for the device otherwise when a person puts their hand into the drain, they will cut their hand. Additionally, it is also important to minimize any edge or surface that could present a collection point for debris.

SUMMARY OF THE INVENTION

Accordingly, what is desired is a linear wall drain that allows for access to the interior of the drain and facilitates the installation of a tile or marble on the surface of a faceplate in a smooth and even manner while at the same time allowing for easy removal and reaffixing of the faceplate.

It is further desired to provide a linear wall drain that allows for easy removal and reaffixing of the faceplate in a self-aligning fashion.

It is still further desired to provide a linear wall drain that allows for easy removal and reaffixing of the faceplate where the faceplate is maintained in proper alignment in a robust fashion.

It is also desired to provide a linear wall drain that allows for easy removal and reaffixing of the faceplate where the attachment mechanism for holding the faceplate is robust such that multiple removals will not degrade the attachment mechanism.

It is yet further desired to provide a linear wall drain where, in the event the attachment mechanism does become compromised, it can be replaced with having to disassemble the faceplate and any masonry attached thereto.

These and other objects are achieved in one configuration by the provision of a linear wall drain that has an elongated body with an opening on the front to allow water to pass into the elongated body. The elongated body is provided with a pan forming the lower portion of the elongated body and having an opening that allows water to escape from the linear drain and into the waste water collection system. Preferably the elongated body is formed as a single unitary structure made of stainless steel. The opening may be provided with a flange portion extending around the opening, which allows a finish material (e.g., tile, marble, etc.) to be applied over the flange allowing water to pass directly from the shower, through the opening and into the pan of the linear drain. An upper portion of the opening may include a recessed front wall that faces outward toward the opening and extends a length of the elongated body.

The linear wall drain can still further include a faceplate that is detachably affixed to the recessed front wall and fits substantially within the opening. It is contemplated that the faceplate may comprise a front facing and have an upturned edge that runs around the perimeter of the faceplate. The front facing can be provided as a substantially flat surface and is adapted to allow for the finish material (e.g., tile, marble, etc.) to be directly mounted thereon, The faceplate is sized such that, when the face plate is installed on the recessed front wall the faceplate comprises the majority of the opening while leaving a narrow opening below the bottom edge of the faceplate and the bottom edge of the opening. This allows for water from the shower to pass through the narrow opening while at the same time effectively conceals the linear wall drain from casual view. However, the faceplate is detachably removable such that the interior of the elongated body is accessible when the interior of the linear wall drain needs to be cleaned or accessed.

An important feature of the invention is the provision of a transition points on the linear wall drain. For example, it is contemplated that the flange the extends from around the opening will have a lower portion that may extend approximately 90 degrees relative to the opening. The location where the flange meets the lower edge of the opening is provided with a transition portion comprising a rounded or a beveled edge where it connects to the elongated body portion forming the linear wall drain. Additionally, the recessed front wall at a lower edge is also provided with a transition portion comprising a rounded or a beveled edge where it connects to the elongated body portion.

In another configuration a magnet is positioned on a back side of the faceplate and a complementary magnet is positioned on the face of the recessed front wall. In this configuration, the two magnets provide a secure holding mechanism by means of magnetic force. In another configuration, at least two pairs of magnets are provided. In yet another configuration, at least four pairs of magnets are provided.

It is contemplated that each of the magnets may be provided with an enclosure to contain the magnet. Each of the enclosures could comprise stainless steel and are positioned on the face of the recessed front wall and back side of the faceplate respectively such that when the enclosures are aligned the faceplate is properly positioned within the opening. In one configuration, the enclosures positioned on the back side of the faceplate can further include a recessed that is adapted to receive an enclosure that corresponds to the magnet pair. This allows for multiple advantages including, eases of alignment of the faceplate, functions as spacer to maintain the faceplate the correct distance from the recessed front wall, and acts as a mechanical support to help bear the weight of the faceplate such that the faceplate does not slip or move downward to sideways within the opening while at the same time allowing for quick and easy removal of the faceplate when needed.

For this application the following terms and definitions shall apply:

The terms "first" and "second" are used to distinguish one element, set, object or thing from another, and are not used to designate relative position or arrangement in time.

The terms "coupled", "coupled to", "coupled with", "connected", "connected to", and "connected with" as used herein each mean a relationship between or among two or more devices, apparatus, components, systems, subsystems, and/or means, constituting any one or more of (a) a connection, whether direct or through one or more other devices, apparatus, components, systems, subsystems, or means and/or (b) a functional relationship in which the operation of any one or more devices, apparatus, components, systems, subsystems, or means depends, in whole or in part, on the operation of any one or more others thereof.

In one configuration a linear wall drain is provided comprising an elongated body having a front opening adapted to receive a fluid, a pan positioned inside the elongated body and having an opening therein to allow a fluid to escape and a recessed front wall positioned within said front opening. The linear wall drain further comprises a detachable faceplate adapted to fit over the recessed front wall, a first magnet positioned on the recessed front wall and a second magnet positioned on the detachable faceplate. The linear wall drain is provided such that the first magnet is adapted to interact with the second magnet to hold the detachable faceplate in position over the recessed front wall.

In another configuration a method for manufacturing a linear wall drain is provided comprising the steps of providing an elongated body having a front opening adapted to receive a fluid, providing a pan inside the elongated body and providing an opening in the pan adapted to allow a fluid to escape. The method further comprises the steps of providing a flange area around the front opening, providing a recessed front wall positioned within said front opening and providing a detachable faceplate adapted to fit over the recessed front wall. The method still further comprises the steps of positioning a first magnet on the recessed front wall and positioning a second magnet on the detachable faceplate. The method is provided such that the first magnet is adapted to interact with the second magnet to hold the detachable faceplate in position over the recessed front wall.

In still another configuration a linear wall drain is provided comprising an elongated body having a front opening adapted to receive a fluid, a pan positioned inside the elongated body and having an opening therein to allow a fluid to escape and a recessed front wall positioned within said front opening. The linear wall drain further comprises a detachable faceplate adapted to fit over the recessed front wall, a first and a second enclosure positioned on the recessed front wall and a first and a second magnet positioned in the first and second enclosures respectively. The linear wall drain still further comprises a first and a second holding mechanism positioned on the detachable faceplate and a third and a fourth magnet positioned in the first and a second holding mechanisms respectively. The linear wall drain is provided such that the first magnet is adapted to interact with the third magnet to hold the detachable faceplate in position relative to the recessed front wall and the third magnet is adapted to interact with the fourth magnet to hold the detachable faceplate in position relative to the recessed front wall.

Other objects of the invention and its particular features and advantages will become more apparent from consideration of the following drawings and accompanying detailed description.

DETAILED DESCRIPTION OF THE INVENTION

Figure 1:
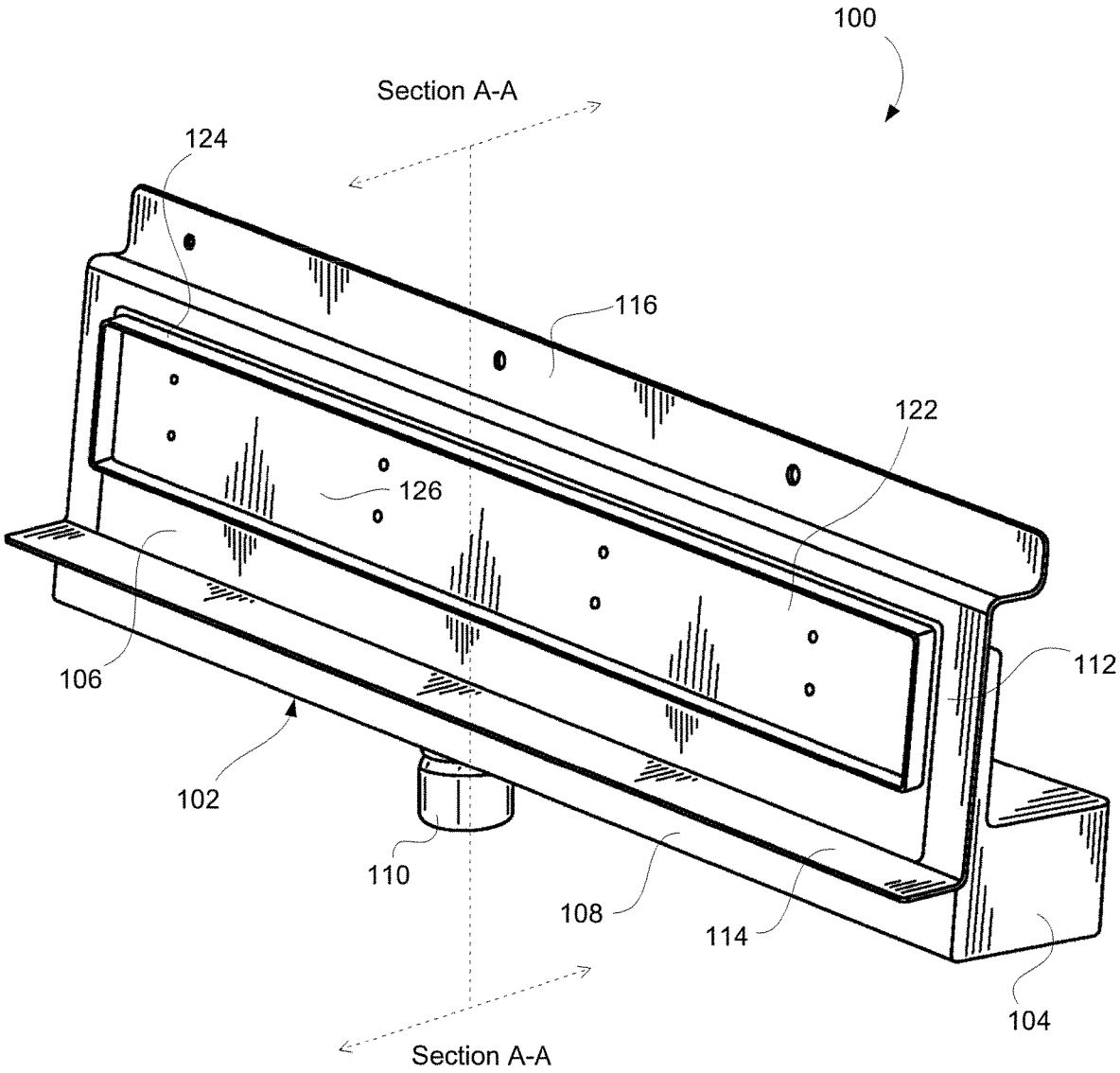
FIG. 1 is a perspective front view of the linear wall drain according to one configuration of the invention.

Referring now to the drawings, wherein like reference numerals designate corresponding structure throughout the views.

Figure 2:
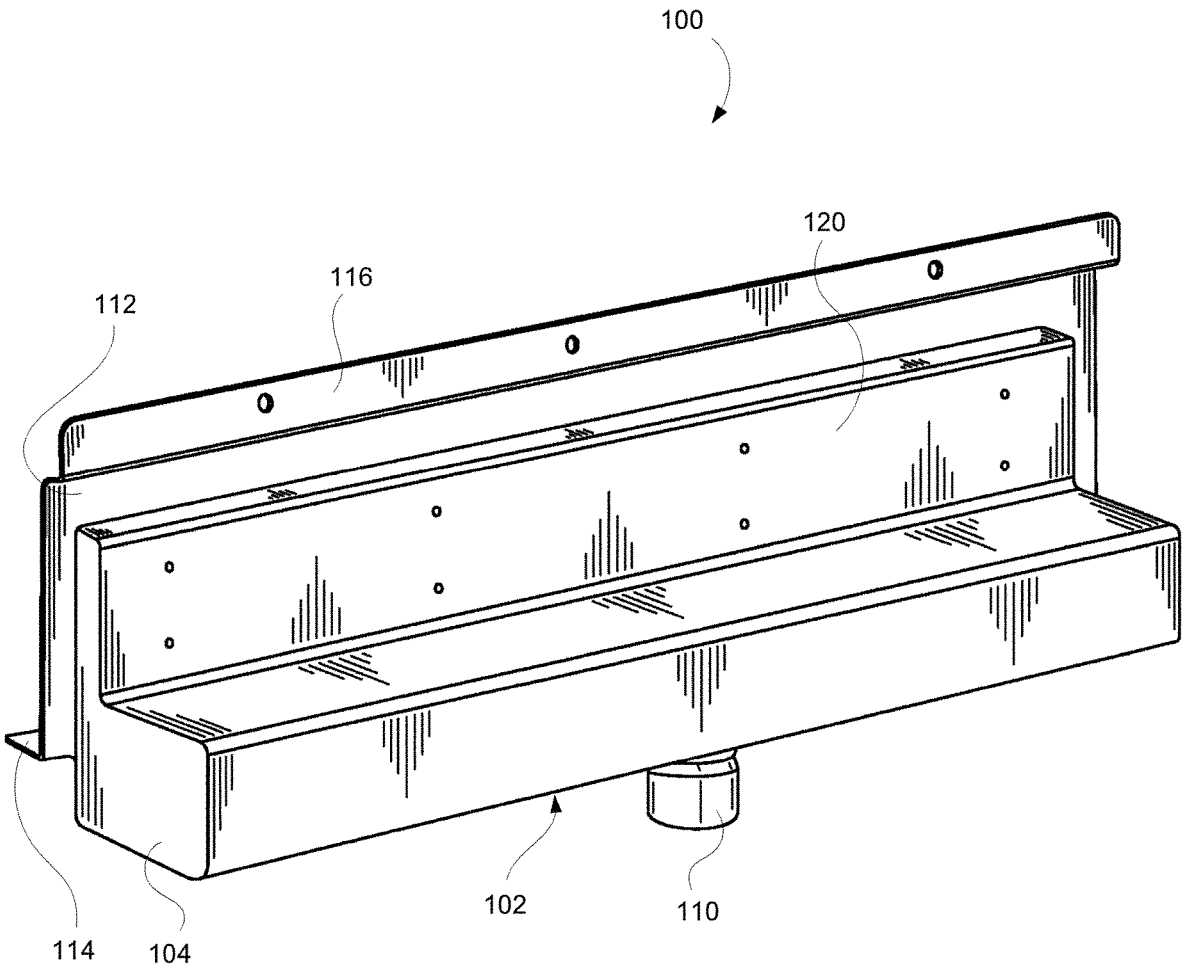
FIG. 2 is a perspective rear view of the linear wall drain according to FIG. 1.

FIGS. 1 and 2 are front and rear perspective views of the linear wall drain 100 according to one configuration of the invention. The linear wall drain 100 includes an elongated body 102 that includes a pan 104 that is adapted to receive a fluid therein. The elongated body 102 includes an opening 106 in a front face 108 thereof. In one configuration, the linear wall drain 100 comprises stainless steel, but could comprise other suitable materials.

A pipe connector 110 extends from a bottom portion of the pan 104 and is adapted to be connected to a sewer pips such that water that enters the linear wall drain through the opening 106 and passes into pan 104 will be allowed to exit through a hole 111 (FIG. 4) in the bottom of pan 104 and pass through pipe connector 110 and into the waste water management system.

Also depicted in FIGS. 1 and 2 is a flange 112 that extends around a perimeter of opening 106. The flange 112 includes a lower portion 114 that extends along a length of the elongated body 102 and extends outward at approximately a 90-degree angle relative to front face 108. Also shown is an upper portion 116 of flange 112 that may be an L-shaped configuration extending perpendicular from flange 112. Both the lower portion 114 and the upper portion 116 are designed to lay flat against respective surfaces (e.g., in a corner of the shower where the wall meets the floor) and allow for a finish material to extend thereover. For example, it is contemplated that tile or marble or other finish material will extend over and cover lower portion 114 that would sit on the floor of the shower under the finish material. Likewise, a wall board material to which a finish material is adhered could extend over upper portion 116. Additionally, it is contemplated that the flange 112 could be covered by the finish material.

Figure 3:
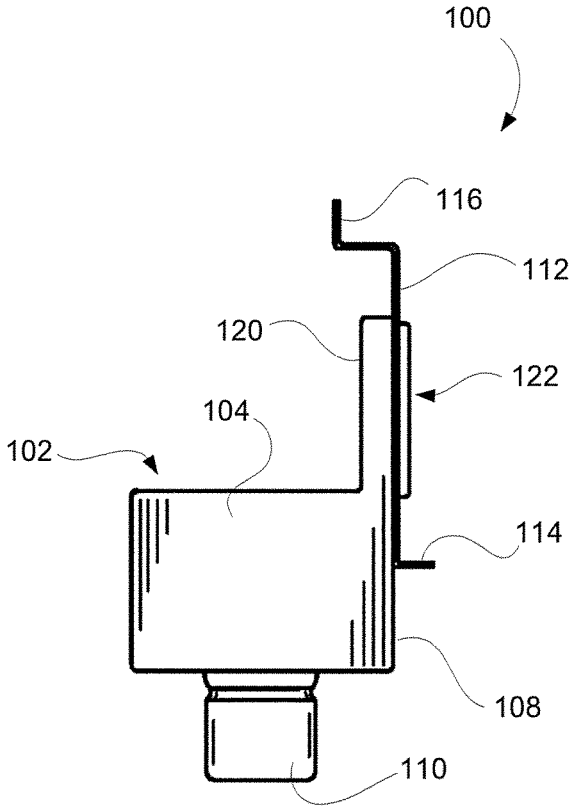
FIG. 3 is a side view of the linear wall drain according to FIG. 1.

Also provided is recessed front wall 120 (a backside thereof is depicted in FIG. 2, see also FIGS. 3 & 4), which is adapted to be covered by faceplate 122. Faceplate 122 is provided with an upturned edge 124 that extends around a perimeter of thereof. The upturned edge 124 forms a cavity 126 within which a finish material can be positioned. For example, a tile or marble could be positioned within cavity 126 and secured with thin set or another suitable material. In this manner, when the faceplate 122 is positioned on recessed front wall 120, the linear wall drain 100 is difficult for the casual observer to see as the finish material extends over the flange 112 and covers the faceplate 122.

Figure 4:
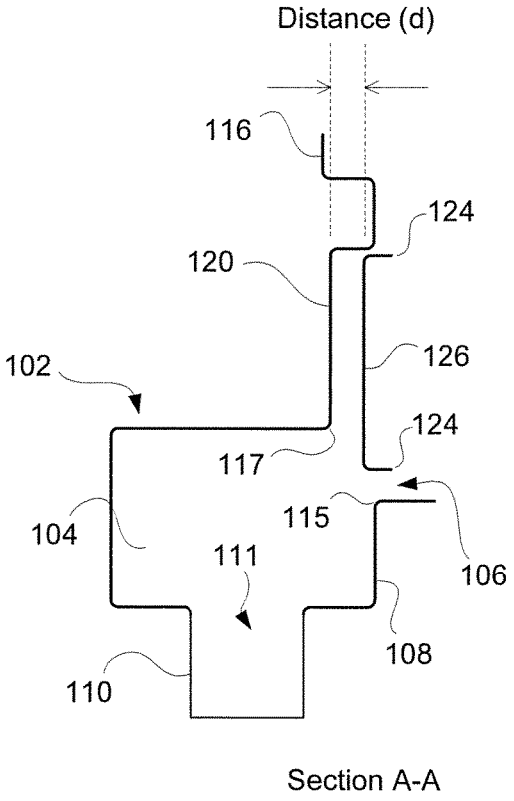
FIG. 4 is a cross sectional view of the linear wall drain according to FIG. 1.

With reference to FIG. 4, it can be seen that opening 106 includes a lower front edge 115 and an upper front edge 117 each comprising either a rounded or beveled surface. The beveled or rounded surfaces are advantageous in that when the faceplate 122 is removed to allow access to the interior of the pan 104 for cleaning and/or maintenance purposes, the edges will not cut or hand of personnel that reach into the pan 104 nor will particles or debris have a tendency to get caught on the edges 115, 117.

Figure 5:
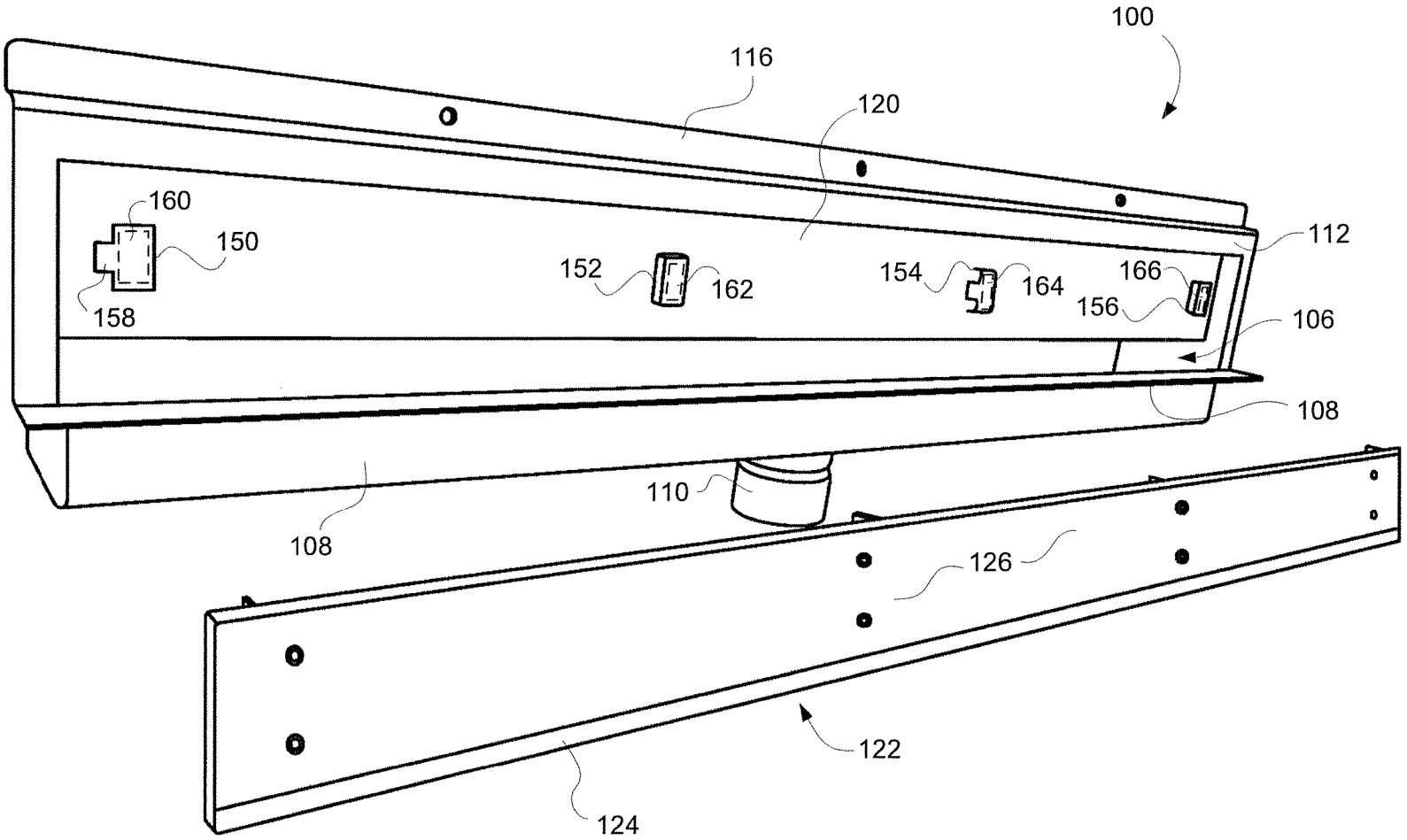
FIG. 5 is a perspective front view of the linear wall drain according to FIG. 1 with the faceplate removed.
Figure 6:
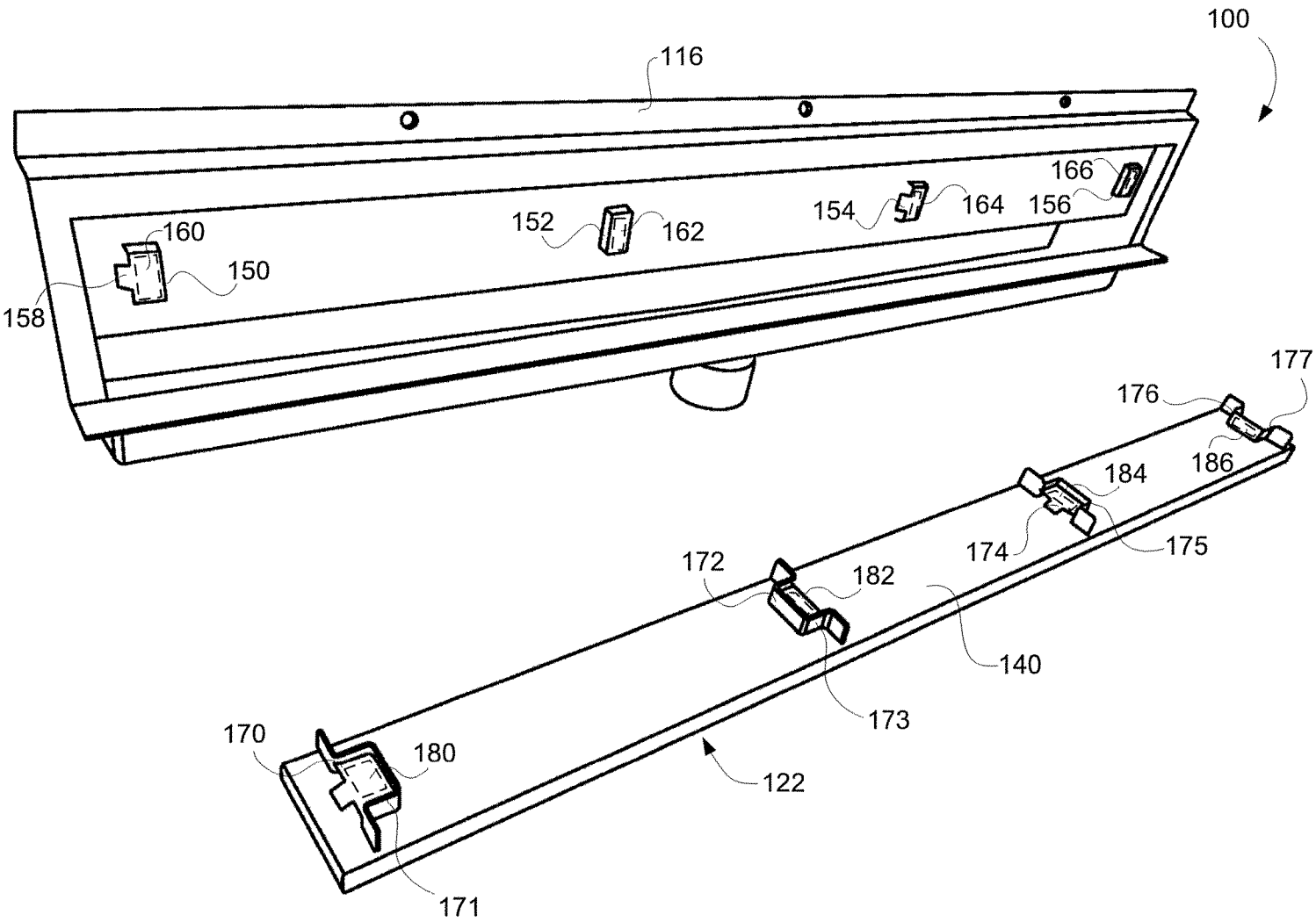
FIG. 6 is a perspective front view of the linear wall drain according to FIG. 5.

Turning now to FIGS. 5 and 6, the removable nature of faceplate 122 is illustrated removed from elongated body 102. It can be see that a first enclosure 150, a second enclosure 152, a third enclosure 154 and a fourth enclosure 156 are positioned on recessed front wall 120. In one configuration these enclosures are stainless steel and are welded onto recessed front wall 120. Inside each of the enclosures 150, 152, 154, 156 a magnet first magnet 160, a second magnet 162, a third magnet 164 and a fourth magnet 166 are positioned. The magnets 160, 162, 164, 166 are depicted as dashed lines to illustrate their placement as they are maintained within the enclosures 150, 152, 154, 156. In one embodiment, a tab 158 is provided that covers an opening in the lateral side of the enclosures 150, 152, 154, 156 allowing access for insertion of the magnets 160, 162, 164, 166. However, it is contemplated that any type of holding mechanism can effectively be used.

Referring now to FIG. 6 a back side 140 of faceplate 122 is depicted including a first holding mechanism 170 that includes an enclosure for holding a first magnet 180. The first holding mechanism 170 includes a lateral side opening including a tab 178 that allow access for insertion of the magnet 180. The first holding mechanism 170 also includes upturned edges 171 that are configured to fit around enclosure 150 when the faceplate 122 is positioned on the recessed front wall 120.

The configuration is similar for second holding mechanism 172 that includes an enclosure for holding a first magnet 182 and includes upturned edges 173 that are configured to fit around enclosure 152. Additionally, third holding mechanism 174 includes an enclosure for holding a first magnet 184 and includes upturned edges 175 that are configured to fit around enclosure 154. Finally, fourth holding mechanism 176 includes an enclosure for holding a first magnet 186 and includes upturned edges 177 that are configured to fit around enclosure 156.

In operation, when faceplate 122 is positioned on recessed front wall 120 as depicted in FIG. 1, the first, second, third and fourth holding mechanisms 170, 172, 174, 176 align with first, second, third and fourth enclosures 150, 152, 154, 156, with the upturned edges 171, 173, 175, 177 providing for alignment and spacing of the faceplate 122 relative to recessed front wall 120. The magnets 160, 162, 164, 166 interact with magnets 180, 182, 184, 186 respectively to firmly hold the faceplate 122 to recessed front wall 120.

With reference to FIG. 4, it can be seen that the faceplate 122 will be maintained at a distance (d) from recessed front wall 120. This is desirable because the faceplate 122 will have a finish material affixed to the face thereof as previously described and the spacing will ensure that the outer edge of the faceplate 122 lays flat and even relative to the wall in the shower on which the other finish material is adhered to.

As can be seen in FIGS. 5 and 6, the proximity of the magnets 160, 162, 164, 166 to magnets 180, 182, 184, 186 can provide a very robust and secure connection. Additionally, the interaction of the upturned edges 171, 173, 175, 177 provides a mechanical support component such that the faceplate does not sag downward or inadvertently move relative to the recessed front wall 120.

Additionally, the tabs that are provided on the various enclosures 150, 152, 154, 156 and the various holding mechanisms 170, 172, 174, 176 allow for the magnets 160, 162, 164, 166, 180, 182, 184, 186 to be replaced if needed. The tabs can simply be pulled outward and the magnets removed and replaced should this become necessary.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A linear wall drain comprising:

an elongated body having:

a front opening adapted to receive a fluid;

a pan positioned inside the elongated body and having an opening therein to allow a fluid to escape;

a recessed front wall positioned within said front opening;

a detachable faceplate adapted to fit over said recessed front wall;

a first magnet positioned within a first enclosure positioned on said recessed front wall;

a second magnet positioned within a first holding mechanism positioned on a rear face of said detachable faceplate;

wherein said first magnet is adapted to interact with said second magnet and said first enclosure is adapted to interact with said first holding mechanism to hold said detachable faceplate in position over said recessed front wall;

wherein said first holding mechanism comprises upturned walls that mechanically interact with the first enclosure to provide mechanical support to hold said detachable faceplate in a predetermined position relative to said recessed front wall.

2. The linear wall drain according to claim 1, wherein said first enclosure and first holding mechanism are adapted to mechanically interact with each other.

3. The linear wall drain according to claim 2, wherein said first holding mechanism comprises a cavity that is adapted to interact with said first enclosure.

4. The linear wall drain according to claim 1, wherein the first enclosure and the first holding mechanism each comprise a deformable tab adapted to allow the first and second magnets to be removeably held within the first enclosure and the first holding mechanism respectively.

5. The linear wall drain according to claim 1, wherein said wall drain further comprises:

a third magnet positioned on said recessed front wall and spaced apart from the first magnet; and a second enclosure positioned on said recessed front wall and spaced apart from the first enclosure and the third magnet is positioned in the second enclosure.

6. The linear wall drain according to claim 5, wherein said wall drain further comprises:

a fourth magnet positioned on said rear face of said detachable faceplate and spaced apart from the second magnet; and a second holding mechanism positioned on said rear face of said detachable faceplate and spaced apart from the first holding mechanism and the fourth magnet is positioned in the second holding mechanism.

7. The linear wall drain according to claim 6, wherein said first and second holding mechanisms each comprise upturned walls that mechanically interact with the first and second enclosures to provide mechanical support to hold detachable faceplate in a predetermined position relative to said recessed front wall.

8. The linear wall drain according to claim 6, wherein said first and second holding mechanisms function as spacers to hold said detachable faceplate at a distance (d) relative to said recessed front wall.

9. The linear wall drain according to claim 1, wherein said elongated body comprises stainless steel.

10. The linear wall drain according to claim 1, wherein said front opening includes a lower front edge comprising either a rounded or beveled surface.

11. A method for manufacturing a linear wall drain comprising the steps of:

providing an elongated body having a front opening adapted to receive a fluid;

providing a pan inside the elongated body;

providing an opening in the pan adapted to allow a fluid to escape;

providing a flange area around the front opening;

providing a recessed front wall positioned within said front opening;

positioning a first enclosure on the recessed front wall;

positioning a first magnet within the first enclosure;

providing a detachable faceplate adapted to fit over the recessed front wall;

positioning a first holding mechanism on a rear face of the detachable faceplate;

positioning a second magnet within the first holding mechanism;

the first magnet being adapted to interact with the second magnet; and the first enclosure being adapted to interact with the first holding mechanism to function as a spacer to hold the detachable faceplate at a distance (d) relative to the recessed front wall.

12. The method according to claim 11, further comprising the step of providing a cavity in conjunction with the first holding mechanism such that the first holding mechanism is adapted to mechanically interact with the first enclosure.

13. The method according to claim 12, further comprising the steps of:

positioning a second enclosure on the recessed front wall;

positioning a third magnet within the second enclosure;

positioning a second holding mechanism on a rear face of the detachable faceplate; and positioning a fourth magnet within the second holding mechanism.

14. The method according to claim 13, further comprising the steps of:

positioning a third enclosure on the recessed front wall;

positioning a fifth magnet within the third enclosure;

positioning a third holding mechanism on a rear face of the detachable faceplate;

positioning a sixth magnet within the third holding mechanism;

positioning a fourth enclosure on the recessed front wall;

positioning a seventh magnet within the fourth enclosure;

positioning a fourth holding mechanism on a rear face of the detachable faceplate; and positioning an eighth magnet within the fourth holding mechanism.

15. A linear wall drain comprising:

an elongated body having:

a front opening adapted to receive a fluid;

a pan positioned inside the elongated body and having an opening therein to allow a fluid to escape;

a recessed front wall positioned within said front opening;

a detachable faceplate adapted to fit over said recessed front wall;

a first and a second enclosure positioned on said recessed front wall;

a first and a second magnet positioned in said first and second enclosures respectively;

a first and a second holding mechanism positioned on a rear face of said detachable faceplate;

a third and a fourth magnet positioned in said first and a second holding mechanisms respectively;

wherein said first magnet is adapted to interact with said third magnet to hold said detachable faceplate in position relative to said recessed front wall; and wherein said third magnet is adapted to interact with said fourth magnet to hold said detachable faceplate in position relative to said recessed front wall;

wherein said first and second holding mechanisms function as spacers to hold said detachable faceplate at a distance (d) relative to said recessed front wall.

16. The linear wall drain according to claim 15, wherein said first enclosure and said first holding mechanism are adapted to mechanically interact with each other and said second enclosure and said second holding mechanism are adapted to mechanically interact with each other.

17. The linear wall drain according to claim 16, wherein said first holding mechanism comprises a cavity that is adapted to interact with said first enclosure and said second holding mechanism comprises a cavity that is adapted to interact with said second enclosure.

18. A linear wall drain comprising:

an elongated body having:

a front opening adapted to receive a fluid;

a pan positioned inside the elongated body and having an opening therein to allow a fluid to escape;

a recessed front wall positioned within said front opening;

a detachable faceplate adapted to fit over said recessed front wall;

a first magnet positioned within a first enclosure positioned on said recessed front wall;

a second magnet positioned within a first holding mechanism positioned on a rear face of said detachable faceplate;

wherein said first magnet is adapted to interact with said second magnet and said first enclosure is adapted to interact with said first holding mechanism to hold said detachable faceplate in position over said recessed front wall;

wherein said first holding mechanism functions as a spacer to hold said detachable faceplate at a distance (d) relative to said recessed front wall.

19. The linear wall drain according to claim 18, wherein said first holding mechanism comprises a cavity that is adapted to interact with said first enclosure.

20. The linear wall drain according to claim 18, wherein the first enclosure and the first holding mechanism each comprise a deformable tab adapted to allow the first and second magnets to be removeably held within the first enclosure and the first holding mechanism respectively.

21. The linear wall drain according to claim 18, wherein said wall drain further comprises:

a third magnet positioned on said recessed front wall and spaced apart from the first magnet;

a second enclosure positioned on said recessed front wall and spaced apart from the first enclosure and the third magnet is positioned in the second enclosure;

a fourth magnet positioned on said rear face of said detachable faceplate and spaced apart from the second magnet; and a second holding mechanism positioned on said rear face of said detachable faceplate and spaced apart from the first holding mechanism and the fourth magnet is positioned in the second holding mechanism.

22. The linear wall drain according to claim 21, wherein said first and second holding mechanisms each function as a spacer to hold said detachable faceplate at a distance (d) relative to said recessed front wall.

* * * * *